US005219477A

United States Patent [19]

Nader et al.

[11] Patent Number: 5,219,477

[45] Date of Patent: Jun. 15, 1993

[54] ANTIOXIDANT-CONTAINING CYCLOPHOSPHAZENE COMPOSITIONS, ANTIOXIDANTS FOR USE THEREIN, AND METHOD THEREFOR

[75] Inventors: Bassam S. Nader; Muthiah N. Inbasekaran, both of Midland, Mich.

[73] Assignee: The Dow Chemical Company, Midland, Mich.

[21] Appl. No.: 685,389

[22] Filed: Apr. 15, 1991

[51] Int. Cl.[5] ..... C10M 137/16

[52] U.S. Cl. ..... 252/26; 252/35; 252/39; 252/41; 252/49.6; 252/49.9; 252/400.5; 252/400.52; 252/400.53; 252/400.61; 252/400.62

[58] Field of Search ..... 252/26, 49.9, 49.6, 252/35, 39, 41, 400.5, 400.52, 400.53, 400.61, 400.62

[56] References Cited

U.S. PATENT DOCUMENTS

| | | | |
|---|---|---|---|
| 3,236,773 | 2/1966 | Stemniski et al. | 252/42.7 |
| 3,313,731 | 4/1967 | Dolle et al. | 252/49.7 |
| 3,360,467 | 12/1967 | McHugh et al. | 252/74 |
| 3,393,151 | 7/1968 | Dolle et al. | 252/49.9 |
| 3,481,872 | 12/1969 | Dolle et al. | 252/49.7 |
| 3,490,737 | 1/1970 | Gieseking et al. | 252/25 |
| 3,492,229 | 1/1970 | Weiss | 252/25 |
| 3,499,041 | 3/1970 | Tamborski | 260/612 |
| 3,625,893 | 12/1971 | Brook | 252/400.52 |
| 3,674,822 | 7/1972 | Stemniski | 260/429.7 |
| 3,867,462 | 2/1975 | Keeney et al. | 252/400.4 |
| 3,986,965 | 10/1976 | Clark et al. | 252/32.5 |
| 4,011,267 | 3/1977 | Tamborski et al. | 260/606.5 P |
| 4,043,926 | 8/1977 | Snyder et al. | 252/49.9 |
| 4,097,388 | 6/1978 | Snyder et al. | 252/49.9 |
| 4,176,075 | 11/1979 | Alexander et al. | 252/400.62 |
| 4,211,663 | 7/1980 | Braid | 252/400.62 |
| 4,431,555 | 2/1984 | Christian et al. | 252/49.9 |
| 4,431,556 | 2/1984 | Christian et al. | 252/49.9 |
| 4,454,349 | 6/1984 | Tamborski et al. | 568/13 |
| 4,601,843 | 7/1986 | Carr et al. | 252/49.9 |
| 4,665,117 | 5/1987 | Quinn | 252/400.62 |
| 4,743,397 | 5/1988 | Quinn | 252/400.62 |
| 5,015,405 | 5/1991 | Kar et al. | 252/49.9 |

OTHER PUBLICATIONS

Ravner, et al., High-Temperature Stabilization of Polyphenyl Ethers By Inorganic Salts, 1971, vol. 15, pp. 45-53.

Stemniski et al., Antioxidants for High-Temperature Lubricants, 1964, vol. 7, pp. 43-54.

Ravner et al., Antioxidant Action of Metals and Metal-Organic Salts in Fluoroesters and Polyphenyl Ethers, Oct. 1963, vol. 8, pp. 591-596.

Ravner et al., High-Temperature Stabilization of Polyphenyl Ethers by Soluble Metal-Organic Salts, 1974, vol. 8, pp. 1-4.

*Primary Examiner*—Margaret Medley

[57] ABSTRACT

A cyclophosphazene fluid composition containing organometallic or inorganic metal salts as antioxidants the antioxidants for use therein, and a method therefor, are disclosed herein. Suitable organometallic salts are formed by reacting a metal hydroxide with benzoic acid, substituted benzoic acids, or substituted phenols. The preferred inorganic metal salts effective for this purpose include various metal borates. The metal salt antioxidants are effective for reducing oxidation in the cyclophosphazene fluid in amounts of less than about 1% by weight of the overall composition.

14 Claims, No Drawings

ANTIOXIDANT-CONTAINING CYCLOPHOSPHAZENE COMPOSITIONS, ANTIOXIDANTS FOR USE THEREIN, AND METHOD THEREFOR

TECHNICAL FIELD

This invention relates generally to high temperature lubricating fluids, but more particularly relates to cyclophosphazene fluid compositions containing antioxidants.

BACKGROUND OF THE INVENTION

Antioxidant compositions for conventional jet aircraft lubricating fluids, such as fluoroesters and polyphenyl ethers are well known. Such antioxidants are disclosed in *Antioxidants For High-Temperature Lubricants*, Stemniski et al. ASLE Transactions Vol. 7, p. 43 (1964), and are exemplified by tin-containing compounds such as bis(p-phenoxy phenyl)-diphenyl tin, p-bis(triphenyl stannoxy)-benzene, tetraphenyl tin, tetrakis (p-phenoxy phenyl) tin, bis(p-phenoxy phenyl) tin and diphenyl tin oxide.

As disclosed in *Antioxidant Action of Metals and Metal-Organic Salts in Fluoroesters and Polyphenyl Ethers*, Ravner et al., J. of Chemical and Engineering Data Vol. 8, No. 4, p. 591 (1963), the oxides, hydroxides and carbonates of the alkaline metals and of barium, and copper salts, steel and stainless steel toluates and benzoates of barium, nickel, lead, praseodymium, manganese, cobalt, chromium, titanium and ytterbium all displayed significant antioxidant activity in fluoroesters and polyphenyl ethers. However, more interest has been recently centering on the use of cyclophosphazene fluids for jet aircraft, turbine, and diesel engine lubricating fluids.

The cyclophosphazene fluids which are of current interest for use in jet aircraft, turbine, and diesel engines are highly advanced fluids or lubricants, as they are required to operate well at extremely high temperatures. Conventional antioxidants for the polyphenyl ether fluids, such as aryl tin compounds, are detrimental to cyclophosphazene fluids. To the inventors' knowledge, the cyclophosphazene fluids are new, and they know of no antioxidants which have yet been developed for use in conjunction with these fluids or lubricants. Unfortunately, attempts by the inventors to produce an oxidation-resistant cyclophosphazene from conventional antioxidants had met with failure due to the volatility and insolubility of the conventional antioxidants when combined with the new cyclophosphazene fluids and lubricants.

Therefore, it is a primary object of the invention to provide a high temperature stable cyclophosphazene with an effective antioxidant to oxidatively stabilize the cyclophosphazene fluids at the extremely high operating temperatures required for use in jet aircraft, turbine, and diesel engines.

It is another object of the present invention to provide a method for solubilizing a non-volatile antioxidant into cyclophosphazene fluids.

It is yet another object of the present invention to provide a formulation and method for preparing cyclophosphazene fluids containing an effective antioxidant in order to improve the upper operating temperature limit of the fluids.

It is yet another object of the invention to provide antioxidants designed to be blended with cyclophosphazene fluids and lubricants.

SUMMARY OF THE INVENTION

In accordance with some preferred embodiments of the invention, these and other objects and advantages are addressed as follows.

An oxidatively stabilized cyclophosphazene fluid is disclosed which includes organometallic or inorganic metal salts as antioxidants. The organometallic salts of the present invention include the reaction product of a metal hydroxide with benzoic acid, substituted benzoic acids or substituted phenols. The metal hydroxide may be selected from the group consisting of alkali metal hydroxides, alkaline earth metal hydroxides and transition metal hydroxides. A preferred hydroxide is barium hydroxide.

Another embodiment of this invention discloses cyclophosphazene fluids with antioxidants including inorganic salts such as metal borates, more specifically nickel borate, lithium borate and barium borate. Each of the named borates are highly effective as antioxidants for the cyclophosphazene fluids operating at temperatures equal to or exceeding 250° C.

Further disclosed is a method for producing an organometallic antioxidant-containing cyclophosphazene fluid or lubricant comprising the steps of reacting a compound selected from the group consisting of benzoic acid, substituted benzoic acids, and substituted phenols with a metal hydroxide selected from the group consisting of alkali metal hydroxides, alkaline earth metal hydroxides and transition metal hydroxides, to form a metal phenate, adding between about 0.1 and about 1.0 weight percent of the resultant metal phenate, based on the resultant composition, to between about 99.0 and about 99.9 weight percent cyclophosphazene fluid, based on the resultant composition, in the presence of an organic solvent such as methylene chloride, and then removing the solvent under vacuum.

An alternative method for preparing the cyclophosphazene antioxidant composition comprises combining, per the method outlined above, a commercially available inorganic borate such as barium borate, nickel borate or lithium borate, with a cyclophosphazene fluid as described further hereinbelow.

The effectiveness of the antioxidant activity of the organometallic or inorganic metal salts in the cyclophosphazene fluids was entirely unexpected, as cyclophosphazene generally undergoes oxidation via a completely different pathway from oxidation which occurs in fluoroesters and polyphenyl ethers.

DETAILED DESCRIPTION OF THE INVENTION

Cyclophosphazene fluids or lubricants are being developed for automotive and aeronautical applications that have performance requirements which are dramatically different from those of engines currently in use. It is anticipated that these engines will generally operate at temperatures exceeding 250° C., and will therefore require lubricants and lubricant additives that are stable at this elevated temperature while possessing the other normal properties required of a lubricant. Since these fluids are still in the developmental stages, antioxidants effective to resist substantial oxidation are generally not known at the present time.

The compounds of this invention are useful over extended temperature ranges. They may be used alone or they may be used in conjunction with various additives to improve their performance. Additionally, they may themselves be used as additives with other base stocks.

The following paragraphs describe the preferred base stock cyclophosphazene fluids first, followed by discussions of the various antioxidants which we have found to be especially useful. The antioxidants are added to this base stock as described in the method descriptions following the discussion of the antioxidant compositions.

1. Base Stock Cyclophosphazene Fluids

The cyclophosphazene fluids used with the antioxidants of the present invention contain predominantly trimeric oligomers. However, test results show that the fluids all contain at least minor amounts of higher oligomers. The trimeric oligomers (cyclotriphosphazene) comprise at least about 90 percent or more of the cyclophosphazene fluid, while the tetrameric oligomers and other higher oligomers may comprise up to about 10 percent of the cyclophosphazene fluid.

The cyclophosphazenes preferably correspond to the formula:

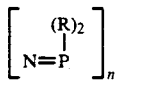

wherein n is 3 through 7, R is individually in each occurrence fluorinated phenoxy or 3-perfluoroalkylphenoxy with the proviso that the ratio of fluorinated phenoxy to 3-perfluoralkylphenoxy ranges from about 1:5 to about 1:1.

The fluorinated phenoxy moieties contain from one to five fluorine atoms. It is preferred that the fluorinated phenoxy moiety contains one fluorine atom and that the fluorine atom is ortho, meta, or para to the oxygen atom of the phenoxy moiety. The perfluoroalkyl group of the meta-perfluoroalkylphenoxy is preferably a lower perfluoroalkyl group having from one to about five carbon atoms and is most preferably a trifluoromethyl group. The preferred fluorinated phenoxy moiety is selected from the group consisting of 3-(3-trifluoromethylphenoxy)phenol and bis(3-phenoxyphenol).

The ratio of fluorinated phenoxy to perfluoroalkylphenoxy substituents ranges from about 1:5 to about 1:1. It is preferred that the ratio ranges from about 1:2 to about 1:1. It is more preferred that the ratio is about 1:2. While the cyclophosphazene compounds are described as single molecules having specified substituents present in a stated ratio, it will be realized by one skilled in the art that the compounds actually exist as statistical mixtures of molecules. Some of these molecules will have higher or lower ratios. However, the phosphazenes will, within these statistical mixtures, have substituents present at the specified ratios.

The following are non-limiting examples of the cyclophosphazenes wherein the m-perfluoroalkyl phenoxy substituent is a 3-fluoromethyl phenoxy moiety. These examples include 2,2,4,4,6,6-di(4-fluorophenoxy)tetra(3-trifluoromethylphenoxy)-1,3,5-triaza-2,4,6-triphosphorine, 2,2,4,4,6,6-di(3-fluorophenoxy)tetra(3-trifluoromethylphenoxy)-1,3,5-triaza-2,4,6triphosphorine, 2,2,4,4,6,6-di(2-fluorophenoxy)tetra(3-trifluoromethylphenoxy)-1,3,5-triaza-2,4,6-triphosphorine, 2,2,4,4,6,6-tri(2-fluorophenoxy)tri(3-trifluoromethylphenoxy)-1,3,5-triaza-2,4,6-triphosphorine, 2,2,4,4,6,6-tri(3-fluorophenoxy)tri(3-trifluoromethylphenoxy)-1,3,5-triaza-2,4,6-triphosphorine, 2,2,4,4,6,6-tri(4-fluorophenoxy)tri(3-trifluoromethylphenoxy)-1,3,5-triaza-2,4,6-triphosphorine, 2,2,4,4,6,6,8,8-tri(4-fluorophenoxy)penta(3-trifluoromethylphenoxy)-1,3,5,7-tetraza-2,4,6,8-tetraphosphorine, 2,2,4,4,6,6,8,8-tri(3-fluorophenoxy)penta(3-trifluoromethylphenoxy)-1,3,5,7-tetraza-2,4,6,8-tetraphosphorine, 2,2,4,4,6,6,8,8-tetra(4-fluorophenoxy)tetra(3-trifluoromethylphenoxy)-1,3,5,7-tetra-2,4,6,8-tetraphosphorine, 2,2,4,4,6,6,8,8-2.57(3-fluorophenoxy)-5.43(3-trifluoromethylphenoxy)-1,3,5,7-tetraza-2,4,6,8-tetraphosphorine, 2,2,4,4,6,6,8,8-2.57(3-fluorophenoxy)-5.43(3-trifluoromethylphenoxy)-1,3,5,7-tetraza-2,4,6,8-tetraphosphorine, 2,2,4,4,6,6,8,8-2.57(4-fluorophenoxy)-5.43(3-trifluoromethylphenoxy)-1,3,5,7-tetraza-2,4,6,8-tetraphosphorine and mixtures thereof. In a preferred embodiment, the cyclophosphazene is either 2,2,4,4,6,6-di(3-fluorophenoxy)tetra(m-trifluoromethylphenoxy)-1,3,5-triaza-2,4,6-triphosphorine, 2,2,4,4,6,6-di(4-fluorophenoxy)tetra(m-trifluoromethylphenoxy)-1,3,5-triaza-2,4,6-triphosphorine, or mixtures thereof.

The cyclophosphazene fluids may be prepared in a one-pot, two-stage reaction. As an example, in the first stage, a fluorinated phenol and a perfluoroalkylphenol are placed into a flask with a solvent. An alkali metal hydroxide is added and the mixture is allowed to reflux followed by the waters of reaction being removed. The mixture is then allowed to cool, a halogenated cyclophosphazene is added, and then the mixture is refluxed. The product is recovered using conventional recovery techniques. The fluorinated phenol, perfluoroalkylphenol and halogenated cyclophosphazene starting materials are commercially available or may be prepared using conventional techniques.

In the preparation of the cyclophosphazene fluids, the fluorinated phenol, the perfluoroalkylphenol and the halogenated phosphazene reactants are used in amounts sufficient to insure that the fluorinated phenol and perfluoroalkylphenol are present in a ratio of from about 1:1 to about 1:2 and the fluorinated phenol and perfluoroalkylphenol substantially replace the halogens on the phosphazene ring. For example, when the cyclophosphazene is predominantly a trimer such as 2,2,4,4,6,6-hexachloro-1,3,5-triaza-2,4,6-triphosphorine, it is preferred to use at least about two moles of fluorinated phenol and at least about four moles of perfluoroalkylphenol per mole of 2,2,4,4,6,6-hexachloro-1,3,5-triaza-2,4,6-triphosphorine. When the phosphazene is a tetramer, it is preferred to use at least about 2.6 moles of fluorinated phenol and at least about 5.4 moles of perfluoroalkylphenol per mole of 2,2,4,4,6,6,8,8-octachloro-1,3,5,7-tetraza-2,4,6,8-tetraphosphorine. It is preferred to use a slight stoichiometric excess each of fluorinated phenol and perfluoroalkylphenol to insure complete reaction.

2. Organometallic Antioxidants

Now that we have described the cyclophosphazenes used as the lubricant base stock, we now look at one of our preferred antioxidants, the organometallics. Antioxidants as described herein are useful in high temperature lubricants to improve performance. In this context, it is preferred that the cyclophosphazene of this invention comprises at least about 50 weight percent, and more preferably at least about 95 weight percent of the lubricating composition, with one or more additives making up the balance. In addition, the cyclophosphazenes of this invention may be blended with other base stocks to prepare lubricants. Most preferably, though, the cyclophosphazene fluid-antioxidant composition of the present invention includes a non-volatile antioxidant portion effective to resist oxidation at concentrations of 1% or less by weight based on total additive weight per volume of lubricant hereinafter referred to as weight per volume and at elevated operating temperatures of 250° C. and higher. Preferably, the antioxidant is present in an amount between about 0.1 and 1.0 weight per volume. The organometallic salts of the present invention include the reaction product of a metal hydroxide with benzoic acid, substituted benzoic acids or substituted phenols as discussed in greater detail below. The metal hydroxide may be selected from the group consisting of alkali metal hydroxides, alkaline earth metal hydroxides and transition metal hydroxides. A preferred hydroxide is barium hydroxide.

Besides the use of pure benzoic acid, non-limiting examples of preferred substituted benzoic acids include phenoxybenzoic acids, phenylbenzoic acids, naphthoic acids, trifluoromethyl phenoxy benzoic acids, trifluoromethoxy benzoic acids, trifluoromethoxy phenoxybenzoic acids, and mixtures thereof. Particularly useful substituted benzoic acids include 2-phenoxybenzoic acid, 3-phenoxybenzoic acid, 4-phenoxybenzoic acid, 2-phenylbenzoic acid, 3-phenylbenzoic acid, 4-phenylbenzoic acid, 1-naphthoic acid, 2-naphthoic acid, 2-(trifluoromethyl)benzoic acid, 3-(trifluoromethyl) benzoic acid, 4-(trifluoromethyl)benzoic acid, 2-(3-trifluoromethyl)phenoxybenzoic acid, 3-(3-trifluoromethyl)phenoxybenzoic acid, 4-(3-trifluoromethyl)-phenoxybenzoic acid, 2-(trifluoromethoxy)benzoic acid, 3-(trifluoromethoxy) benzoic acid, 4-(trifluoromethoxy)benzoic acid, 2-(3-trifluoromethoxy)phenoxybenzoic acid, 3-(3-trifluoromethoxy)phenoxybenzoic acid, and 4-(3-trifluoromethoxy)phenoxybenzoic acid. Of course, advantageous mixtures of any of these compounds in any proportions may be especially useful for varying applications.

Preferred substituted phenols may be any substituted phenol which possesses a high thermal stability. Non-limiting examples of effective substituted phenols are phenoxy phenols, (phenoxy) phenoxy phenols, fluorinated phenoxy phenols, perfluoroalkyl phenoxy phenols, fluoroalkyl (phenoxy) phenoxy phenols, fluoroalkoxy phenoxy phenols, and fluoroalkoxy (phenoxy) phenoxy phenol and mixtures thereof. Non-limiting examples of particularly useful phenols include 2-phenoxyphenol, 3-phenoxyphenol, 4-phenoxyphenol, 2-(3-phenoxy)phenoxyphenol, 3-(3-phenoxy)phenoxyphenol, 4-(3-phenoxy)phenoxyphenol, 2-(4-phenoxy)-phenoxyphenol, 3-(4-phenoxy)phenoxyphenol, 4-(4-phenoxy)phenoxyphenol, 2-(3-trifluoromethyl)phenoxyphenol, 3-(3-trifluoromethyl)phenoxyphenol, 4-(3-trifluoromethyl)phenoxyphenol, 2-{3-(3-trifluoromethyl)-phenoxy}phenoxyphenol, 3-{3-(3-trifluoromethyl-phenoxy}phenoxyphenol, 4-{3-(3-trifluoromethyl)-phenoxy}phenoxyphenol, 2-{4-(3-trifluoromethyl)-phenoxy}phenoxyphenol, 3-{4-(3-trifluoromethyl)-phenoxy}phenoxyphenol, 4-{4-(3-trifluoromethyl)-phenoxy}phenoxyphenol, 2-(3-trifluoromethoxy)-phenoxyphenol, 3-(3-trifluoromethoxy)phenoxyphenol, 4-(3-trifluoromethoxy)phenoxyphenol, 2-{3-(3-trifluoromethoxy)phenoxy}phenoxyphenol, 3-{3-(3-trifluoromethoxy)phenoxy}phenoxyphenol, 4-{3-(3-trifluoromethoxy)phenoxy}phenoxyphenol, 2-{4-(3-trifluoromethoxy)phenoxy}phenoxyphenol, 3-{4-(3-trifluoromethoxy)phenoxy}phenoxyphenol, 4-{4-(3-trifluoromethoxy)phenoxy}phenoxyphenol, 2-(4-trifluoromethoxy)phenoxyphenol, 3-(4-trifluoromethoxy)phenoxyphenol, 4-(4-trifluoromethoxy)phenoxyphenol, 2-{3-(4-trifluoromethoxy)phenoxy}phenoxyphenol, 3-{3-(4-trifluoromethoxy)phenoxy}phenoxyphenol, 4-{3-(4-trifluoromethoxy)phenoxy}phenoxyphenol, 2-{4-(4-trifluoromethoxy)phenoxy}phenoxyphenol, 3-{4-(4-trifluoromethoxy)phenoxy}phenoxyphenol, and 4-{4-(4-trifluoromethoxy)phenoxy}phenoxyphenol.

A method for producing an organometallic antioxidant-containing cyclophosphazene fluid utilizing the compounds described above is disclosed which comprises the steps of reacting a compound selected from the group consisting of benzoic acid, substituted benzoic acids, and substituted phenols with a metal hydroxide selected from the group consisting of alkali metal hydroxides, alkaline earth metal hydroxides and transition metal hydroxides, to form a metal phenate, adding between about 0.1 and about 1.0 weight percent of the resultant metal phenate, based on the resultant composition, to between about 99.0 and about 99.9 weight percent cyclophosphazene fluid, based on the resultant composition, in the presence of an organic solvent such as methylene chloride, and then removing the solvent under vacuum.

3. Inorganic Salt Antioxidants

On the other hand, inorganic salts may be used as the antioxidant. Representative of especially effective inorganic metal salt antioxidants for cyclophosphazene fluids are the inorganic metal borate salts. These inorganic salts include the alkali metal borates, alkaline earth metal borates and transition metal borates. Particularly useful are lithium borate, barium borate and nickel borate. These preparations are commercially available from K & K Laboratories, Division of ICN Biomedicals, Inc., Plainview, N.Y. Although the inorganic metal borates are less soluble than the organometallic salts listed above, excellent antioxidant activity has been found with very low concentrations of the inorganic borates. The borates are effective at concentrations ranging from less than about 0.2 to about 0.25 weight percent. Lithium borate appears to be effective at concentrations of much less than 0.2 weight percent.

The oxidation resistant metal borate-containing cyclophosphazene composition set forth above is prepared by combining between about 0.1 and about 1.0 weight percent metal borate with between about 99.0 and 99.9 weight percent of a cyclophosphazene fluid, mixing with efficient stirring at a temperature of about 120° C. for about 5 minutes, and removing any undissolved metal borate from the mixture by filtration.

The oxidative stabilities of the cyclophosphazene-antioxidant compositions of the present invention were compared to pure cyclophosphazene fluid and the results are set forth in Table A hereinbelow. The results show a significant reduction in acid number in the samples treated with barium salts. The acid numbers of less than 1.0 indicate the presence of little or no acid in the cyclophosphazene fluid after a 24 hour run per test method standard described in Table A. Generally, acids are by-products of oxidation and the lower the acid number, the less oxidation. The absence of acid indicates that these salts effectively inhibit the oxidative degradation process.

The effectiveness of the various organometallic and inorganic metal salts as antioxidants for cyclophosphazene fluids was entirely unexpected. Even though the use of organometallic and inorganic salts as high temperature antioxidants for conventional types of fluids or lubricants (e.g. polyaryl ethers and fluoroesters) has been described in the literature, the antioxidant properties of these salts in cyclophosphazenes was not expected because the oxidative degradation of phosphazene fluids is a completely different mechanism from that of other types of lubricants.

The different oxidative pathways for the polyphenyl ethers and cyclophosphazenes are set forth herein. The antioxidants for the polyphenyl ethers function by formation of a free radical and the subsequent radical-chain reactions with compounds such as phenols which form the more stable radicals. The antioxidant reaction mechanisms are explained in *High-Temperature Stabilization of Polyphenol Ethers by Inorganic Salts*, Ravner et al., American Society of Lubrication Engineers Transactions, Vol. 15, 1, p. 45-53 (1971). The antioxidant acts as an electron sink during the free radical reaction. The overall oxidation rate of the base fluid is curtailed by the antioxidant. The following free radical reaction pathways are among those proposed for the ether.

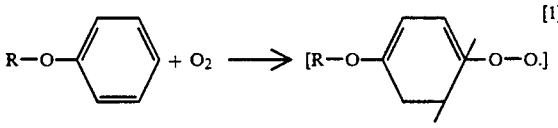

[1]

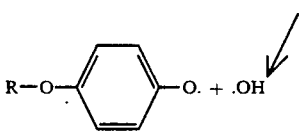

[2]

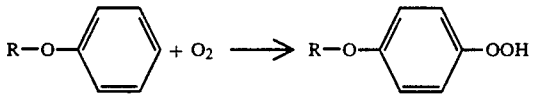

[3]

-continued

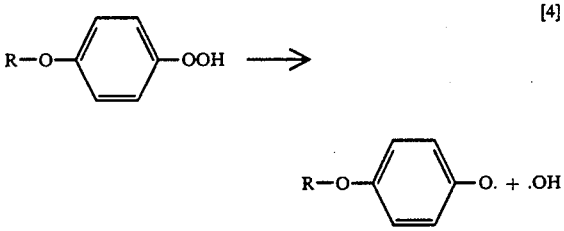

[4]

Oxygen or Impurity Activation:

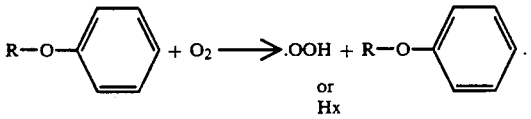

[5]

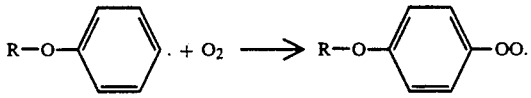

[6]

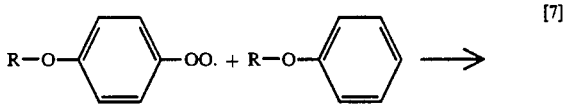

[7]

In contrast to the oxidative mechanism of the polyphenyl ethers, there is no free radical reaction in the oxidation of the cyclophosphazene fluid. The phosphazene oxidizes by a cationic mechanism, the major oxidation products being arylphosphate esters, arylphosphate ester acids, arylphosphate ester amides and arylphosphate ester nitriles. The complete oxidation mechanism of the cyclophosphazenes is not yet understood as research is ongoing. However, it is proposed that the cationic pathway for oxidation of the cyclophosphazene proceeds as follows:

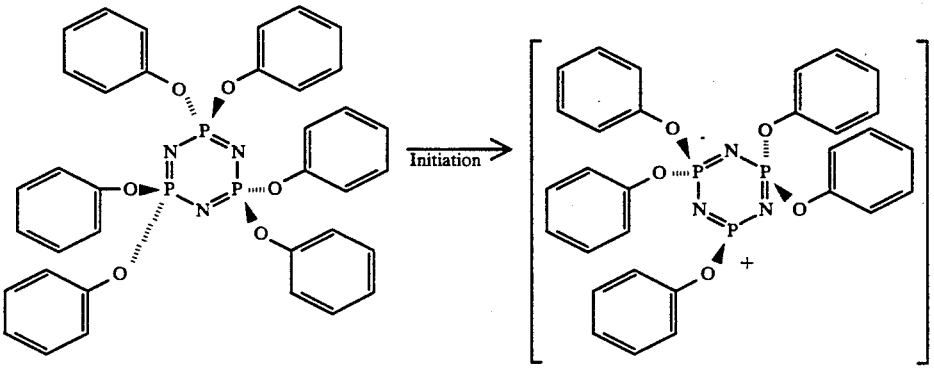

-continued

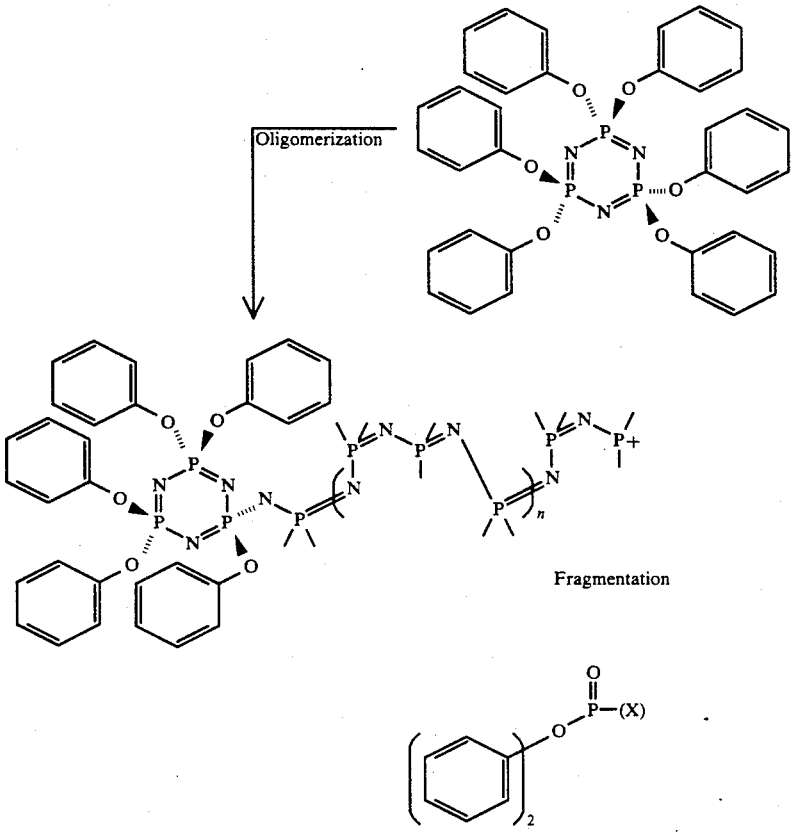

The following examples are provided for illustrative purposes only and should not be construed as limiting the invention in any way. Unless stated otherwise, all parts and percentages are by weight.

In the following examples, the various barium salts and cyclophosphazene fluids mentioned shall have the following structures:

Barium Salt (I): Barium bis{3-(3-trifluoromethylphenoxy)phenate}

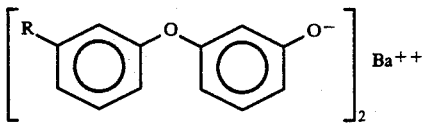

R = $CF_3$

Barium Salt (II): Barium bis(3-phenoxyphenate)

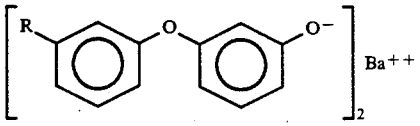

R = H

Cyclophosphazene Fluid (III):

-continued

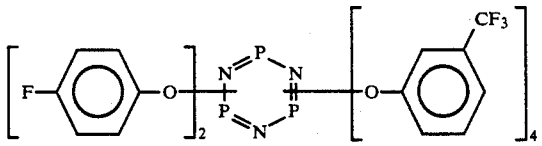

EXAMPLE 1A

Cyclophosphazene fluid III, utilized in the following examples, was tested and found to contain mixtures of trimeric, tetrameric and other higher oligomers of cyclophosphazenes. The cyclophosphazene fluids were prepared with organometallic salt antioxidants as follows. A cyclophosphazene fluid containing barium bis{3-(3-trifluoromethylphenoxy) phenate}(I) as an antioxidant was prepared by reacting barium hydroxide with 3-(3-trifluoromethylphenoxy)phenol and then preparing a 1.0% weight per volume formulation of the barium phenate in the cyclophosphazene fluid III described above by mixing 1.0 weight percent of the barium phosphate and 99.0 weight percent of cyclophosphazene fluid III in methylene chloride to obtain a homogeneous solution. After the solution was finished, the solvent was removed under vacuum. Test results on the total acid number for this sample appear below in Table A.

EXAMPLE 1B

A cyclophosphazene fluid containing barium bis(3-phenoxyphenate) (II) as an antioxidant was prepared by reacting barium hydroxide with (3-phenoxyphenol) to form the barium phenate, and then preparing a 0.5% weight per volume formulation of the phenate in cyclophosphazene fluid III mixing 0.5 weight percent of the barium phenate and 99.5 weight percent of cyclophosphazene fluid III in methylene chloride to obtain a homogenous solution. Again, the solvent was removed under vacuum. Total acid number test results appear below in Table A.

EXAMPLE 1C

A cyclophosphazene fluid containing an inorganic antioxidant was prepared from barium borate and cyclophosphazene fluid III. 0.5 g of commercial barium borate (K&K Laboratories) was mixed with 200 ml of cyclophosphazene fluid III at 120° C. with efficient stirring, followed by gravity filtration of the mixture through filter paper to remove any undissolved barium borate. Test results for this sample are tabulated in Table A below.

The cyclophosphazene fluid-antioxidant compositions of Examples 1A through 1C were tested for oxidative stability in comparison with pure cyclophosphazene fluid III without any antioxidant additives, using a micro-oxidation/corrosion/acid number test procedure. The test conducted was an adaption of Federal Test Method Standard 791 b, Method 5307.1 "Corrosiveness and Oxidation Stability of Aircraft Turbine - Engine Lubricants." The tests were conducted at 290° C. in the absence of metals with an air flow rate of 1 liter/hour for 24 hours, using 20 ml of each formulation per test. At the conclusion of each run, the material was removed from the test tube and determination of its acid number was performed. The table shows a significant reduction in acid number for each antioxidant composition set forth.

TABLE A

| Formulation | Total Acid Number Before Test | After Test | Net Change |
|---|---|---|---|
| Fluid III (pure) | 0.169 | 2.456 | +2.360 |
| Fluid III + 1% wt/vol of Barium Salt I | 0.465 | 0.087 | −0.378 |
| Fluid III + 0.5% wt/vol of Barium Salt II | 0.266 | 0.060 | −0.206 |
| III + <0.5% wt/vol of Barium Borate | 0.200 | 0.158 | −0.042 |

Various other antioxidant compositions, including a tetraaryltin compound, and commercial barium benzoate, and commercial lithium and nickel borate, were tested for oxidative stability in comparison with the pure cyclophosphazene fluid [III] using the same micro-oxidation/corrosion/acid number test procedure as described above with reference to the test results of Table A. Test results are detailed in Table B.

TABLE B

ANTIOXIDANT ADDITIVES IN CYCLOPHOSPHAZENE FLUID III
Micro-oxidation-corrosion/Acid Number Test

| Additive | Net Change in Acid Number |
|---|---|
| None | +2.360 |
| 1% $(3\text{-}CF_3Ph)_4Sn$ | +5.460 |
| 0.5% $(3\text{-}PhOPhO\text{-})_2Ba++$ | −0.206 |
| 1% $\{3\text{-}(3\text{-}CF_3PhO)PhO\text{-}\}_2Ba++$ | −0.378 |
| 0.4% $(PhCOO\text{-})_2Ba++$ | +0.124 |
| <<0.2% $LiBO_2$ | +0.095 |

TABLE B-continued

ANTIOXIDANT ADDITIVES IN CYCLOPHOSPHAZENE FLUID III
Micro-oxidation-corrosion/Acid Number Test

| Additive | Net Change in Acid Number |
|---|---|
| 0.25% $Ba(BO_2)_2$ | −0.042 |
| 0.2% $Ni(BO_2)_2$ | +0.507 |

Temperature = 290° C. (550° F.)
Air flow rate = 1 liter/hour
Run time = 24 hours The absence of acid in these results indicates that oxidation was inhibited by the organometallic barium phenates and the inorganic borate salts. These results also show that aryl tin compounds are ineffective as antioxidants for the cyclophosphazene compounds.

While our invention has been described in terms of specific embodiments, it will be appreciated that other embodiments could readily be adapted by one skilled in the art. Accordingly, the scope of our invention is to be considered limited only by the following claims.

We claim:

1. An oxidation-resistant cyclophosphazene fluid composition comprising a combination of a cyclophosphazene fluid having the formula

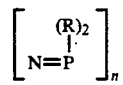

wherein n is 3 through 7, R is individually in each occurrence fluorinated phenoxy or 3-perfluoroalkyl phenoxy, where the ratio of fluorinated phenoxy to 3-perfluoroalkyl phenoxy, ranges from about 1:5 to about 1:1, with at least one non-volatile antioxidant at concentrations of 0.1 to 1.0 by weight, said antioxidant being selected from the group consisting of (a) organometallic salt which is selected from the group consisting of (i) the reaction product of a metal hydroxide and a substituted benzoic acid selected from the group consisting of phenoxy benzoic acid, phenyl benzoic acid, naphthoic acid, trifluoromethyl phenoxy benzoic acid, trifluoromethoxy benzoic acid, trifluoromethoxyphenoxy benzoic acid and mixtures thereof; and (ii) the reaction product of a metal hydroxide and a phenoxy substituted phenol selected from the group consisting of phenoxyphenol, (phenoxy) phenoxyphenol, fluorinated phenoxyphenol, perfluoroalkyl phenoxyphenol, fluoroalkyl (phenoxy) phenoxyphenol, fluoroalkoxy phenoxyphenol, fluoroalkoxy (phenoxy) phenoxyphenol, and mixtures thereof; and (b) a metal borate wherein the metals of the said metal hydroxide and said metal borates are selected from the group consisting of alkali metals, alkaline earth metals and transition metals, wherein said composition is effective to resist oxidation of the cyclophosphazene fluid composition at elevated operating temperatures of about 250° C. and above.

2. The composition of claim 1, wherein the metal hydroxide is barium hydroxide.

3. The composition of claim 1, wherein the substituted phenol is selected from the group consisting of 2-phenoxyphenol, 3-phenoxyphenol, 4-phenoxyphenol, 2-(3-phenoxy)phenoxyphenol, 3-(3-phenoxy)phenoxyphenol, 4-(3-phenoxy)phenoxyphenol, 2-(4-phenoxy)- phenoxyphenol, 3-(4-phenoxy)phenoxyphenol, 4-(4-phenoxy)phenoxyphenol, 2-(3-trifluoromethyl)phenoxyphenol, 3-(3-trifluoromethyl)phenoxyphenol, 4-(3-trifluoromethyl)phenoxyphenol, 2-{3-(3-trifluoromethyl)-phenoxy}phenoxyphenol, 3-{3-(3-trifluoromethyl)-phenoxy}phenoxyphenol, 4-{3-(3-trifluoromethyl)-phenoxy}phenoxyphenol, 2-{4-(3-trifluoromethyl)-phenoxy}phenoxyphenol, 3-{4-(3-trifluoromethyl)-phenoxy}phenoxyphenol, 4-{4-(3-trifluoromethyl)-phenoxy}phenoxyphenol, 2-(3-trifluoromethoxy)-phenoxyphenol, 3-(3-trifluoromethoxy)phenoxyphenol, 4-(3-trifluoromethoxy)phenoxyphenol, 2-{3-(3-trifluoromethoxy)phenoxy}phenoxyphenol, 3-{3-(3-trifluoromethoxy)phenoxy}phenoxyphenol, 4-{4-(3-trifluoromethoxy)phenoxy}phenoxyphenol, 2-{4-(3-trifluoromethoxy)phenoxy}phenoxyphenol, 3-{4-(3-trifluoromethoxy)phenoxy}phenoxyphenol, 4-{4-(3-trifluoromethoxy)phenoxy}phenoxyphenol, 2-(4-trifluoromethoxy)phenoxyphenol, 3-(4-trifluoromethoxy)phenoxyphenol, 4-(4-trifluoromethoxy)phenoxyphenol, 2-{3-(4-trifluoromethoxy)phenoxy}phenoxyphenol, 3-{3-(4-trifluoromethoxy)phenoxy}phenoxyphenol, 4-{3-(4-trifluoromethoxy)phenoxy}phenoxyphenol, 2-{4-(4-trifluoromethoxy)phenoxy}phenoxyphenol, 3-{4-(4-trifluoromethoxy)phenoxy}phenoxyphenol, 4-{4-(4-trifluoromethoxy)phenoxy}phenoxyphenol, and mixtures thereof.

4. The composition of claim 3, wherein the substituted phenol is reacted with barium hydroxide.

5. The composition of claim 1, wherein the substituted benzoic acid is selected from the group consisting of 2-phenoxybenzoic acid, 3-phenoxybenzoic acid, 4-phenoxybenzoic acid, 2-phenylbenzoic acid, 3-phenylbenzoic acid, 4-phenylbenzoic acid; 1-naphthoic acid, 2-naphthoic acid, 2-(trifluoromethyl)benzoic acid, 3-(trifluoromethyl) benzoic acid, 4-(trifluoromethyl)benzoic acid, 2-(3-trifluoromethyl)phenoxybenzoic acid, 3-(3-trifluoromethyl)phenoxybenzoic acid, 4-(3-trifluoromethyl)phenoxybenzoic acid, 2-(trifluoromethoxy)benzoic acid, 3-(trifluoromethoxy) benzoic acid, 4-(trifluoromethoxy)benzoic acid, 2-(3-trifluoromethoxy)phenoxybenzoic acid, 3-(3-trifluoromethoxy)phenoxybenzoic acid, 4-(3-trifluoromethoxy)phenoxybenzoic acid, and mixtures thereof.

6. The composition of claim 1, wherein the metal borate is selected from the group consisting of nickel borate, lithium borate and barium borate.

7. The composition of claim 1, wherein the organometallic salt antioxidant is present in an amount of between about 0.5 and about 1.0 weight percent based on the weight of the resultant cyclophosphazene fluid composition.

8. The composition of claim 1, wherein the inorganic borate salt is present in an amount ranging from less than about 0.25 weight percent based on the weight of the resultant cyclophosphazene fluid composition.

9. A method for forming an oxidation-resistant cyclophosphazene fluid containing an organometallic salt antioxidant, comprising:

(a) reacting a compound selected from the group consisting of (i) substituted benzoic acids selected from the group consisting of phenoxy benzoic acids, phenyl benzoic acids, naphthoic acids, trifluoromethyl phenoxy benzoic acids, trifluoromethoxy benzoic acids, trifluoromethoxyphenoxy benzoic acids and mixtures thereof; and (ii) phenoxy substituted phenols selected from the group consisting of phenoxyphenols, (phenoxy) phenoxyphenols, fluorinated phenoxyphenols, perfluoroalkyl phenoxyphenols, fluoroalkyl (phenoxy) phenoxyphenols, fluoroalkoxyphenoxyphenols, fluoroalkoxy (phenoxy) phenoxyphenols, and mixtures thereof;

with a metal hydroxide selected from the group consisting of alkali metal hydroxide, alkaline earth metal hydroxide and transition metal hydroxide to result in a reaction product;

(b) adding between about 0.1 and about 1.0 weight percent of the resultant reaction product with a cyclophosphazene fluid, having the formula

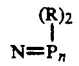

wherein n is 3 through 7, R is individually in each occurrence fluorinated phenoxy or 3-perfluoroalkylphenoxy, where the ratio of fluorinated phenoxy to 3-perfluoroalkylphenoxy ranges from about 1:5 to about 1:1, wherein the cyclophosphazene fluid is utilized in an amount between about 99.0 and 99.9 weight percent of a cyclophosphazene fluid, said weight percents being based on the weight of the resultant cyclophosphazene fluid composition in a solvent to obtain a homogeneous solution; and (c) removing the solvent.

10. The method of claim 9, wherein a compound selected from the group consisting of substituted benzoic acids and phenoxy substituted phenols is reacted with the metal hydroxide with a substituted benzoic acid selected from the group consisting of 2-phenoxybenzoic acid, 3-phenoxybenzoic acid, 4-phenoxybenzoic acid, 2-phenylbenzoic acid, 3-phenylbenzoic acid, 4-phenylbenzoic acid, 1-naphthoic acid, 2-naphthoic acid, 2-(trifluoromethyl)benzoic acid, 3-(trifluoromethyl) benzoic acid, 4-(trifluoromethyl)benzoic acid, 2-(3-trifluoromethyl)phenoxybenzoic acid, 3-(3-trifluoromethyl)phenoxybenzoic acid, 4-(3-trifluoromethyl)phenoxybenzoic acid, 2-(trifluoromethoxy)benzoic acid, 3-(trifluoromethoxy) benzoic acid, 4-(trifluoromethoxy)benzoic acid, 2-(3-trifluoromethoxy)phenoxybenzoic acid, 3-(3-trifluoromethoxy)phenoxybenzoic acid, 4-(3-trifluoromethoxy)phenoxybenzoic acid, and mixtures thereof.

11. The method of claim 9, wherein a compound selected from the group consisting of substituted benzoic acids and phenoxy substituted phenols is reacted with an alkaline earth metal hydroxide.

12. The method of claim 9, wherein a compound selected from the group consisting of substituted benzoic acids and substituted phenols is reacted with barium hydroxide.

13. The method of claim 9, wherein the metal hydroxide is reacted with a substituted phenol selected from the group consisting of 2-phenoxyphenol, 3-phenoxyphenol, 4-phenoxyphenol, 2-(3-phenoxy)phenoxyphenol, 3-(3-phenoxy)phenoxyphenol, 4-(3-phenoxy)-phenoxyphenol, 2-(4-phenoxy)phenoxyphenol, 3-(4-phenoxy)phenoxyphenol, 4-(4-phenoxy)phenoxyphenol, 2-(3-trifluoromethyl)phenoxyphenol, 3-(3-trifluoromethyl)phenoxyphenol, 4-(3-trifluoromethyl)-phenoxyphenol, 2-{3-(3-trifluoromethyl)phenoxy}phenoxyphenol, 3-{3-(3-trifluoromethyl)phenoxy}phenoxyphenol, 4-{3-(3-trifluoromethyl)phenoxy} phenoxyphenol, 2-{4-(3-trifluoromethyl)phenoxy}phenoxyphenol, 3-{4-(3-trifluoromethyl)phenoxy}phenoxyphenol, 4-{4-(3-trifluoromethyl)phenoxy}phenoxyphenol, 2-(3-trifluoromethoxy)phenoxyphenol, 3-(3-trifluoromethoxy)phenoxyphenol, 4-(3-trifluoromethoxy)phenoxyphenol, 2-{3-(3-trifluoromethoxy)phenoxy}phenoxyphenol, 3-{3-(3-trifluoromethoxy)phenoxy}phenoxyphenol, 4-{3-(3-trifluoromethoxy)phenoxy}phenoxyphenol, 2-{4-(3-trifluoromethoxy)phenoxy}phenoxyphenol, 3-{4-(3-trifluoromethoxy)phenoxy}phenoxyphenol, 4-{4-(3-trifluoromethoxy)phenoxy}phenoxyphenol, 2-(4-trifluoromethoxy)phenoxyphenol, 3-(4-trifluoromethoxy)phenoxyphenol, 4-(4-trifluoromethoxy)phenoxyphenol, 2-{3-(4-trifluoromethoxy)phenoxy}phenoxyphenol, 3-{3-(4-trifluoromethoxy)phenoxy}phenoxyphenol, 4-{3-(4-trifluoromethoxy)phenoxy}phenoxyphenol, 2-{4-(4-trifluoromethoxy)phenoxy}phenoxyphenol, 3-{4-(4-trifluoromethoxy)phenoxy}phenoxyphenol, 4-{4-(4-trifluoromethoxy)phenoxy}phenoxyphenol, and mixtures thereof.

14. A method for preparation of an oxidation-resistant cyclophosphazene fluid composition containing an inorganic salt antioxidant, comprising combining between about 0.1 to about 1.0 weight percent of a metal borate selected from the group consisting of lithium borate, nickel borate and barium borate with a cyclophosphazene fluid having the formula

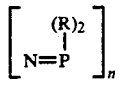

wherein n is 3 through 7, R is individually in each occurrence fluorinated phenoxy or 3-perfluoroalkylphenoxy, where the ratio of fluorinated phenoxy to 3-perfluoroalkylphenoxy ranges from about 1:5 to about 1:1, wherein the cyclophosphazne fluid is utilized in an amount between about 99.0 and 99.9 weight percent of a cyclophosphazene fluid, mixing at a temperature of about 120° C. for about 5 minutes, and then removing any undissolved metal borate.

* * * * *